United States Patent [19]

Zielinski

[11] Patent Number: 4,893,955

[45] Date of Patent: Jan. 16, 1990

[54] THERAPEUTIC SCRUBBING MITTEN

[76] Inventor: Karmella Zielinski, 3 Northumberland Dr., Mount Holly, N.J. 08060

[21] Appl. No.: 152,833

[22] Filed: Feb. 5, 1988

[51] Int. Cl.[4] ..... A46B 11/00; A47L 13/19

[52] U.S. Cl. ..... 401/7; 401/186; 401/201

[58] Field of Search ..... 401/6, 7, 8, 200, 201, 401/186; 15/227; 2/158

[56] References Cited

U.S. PATENT DOCUMENTS

| | | | |
|---|---|---|---|
| D. 268,867 | 5/1983 | Sami . | |
| 660,886 | 10/1900 | Bryan . | |
| 674,912 | 5/1901 | Fike . | |
| 1,283,548 | 11/1918 | O'Reilly . | |
| 1,502,798 | 7/1924 | Phoenix et al. | 401/7 |
| 2,210,754 | 8/1940 | Frank | 15/227 |
| 2,795,806 | 6/1957 | Suttles | 15/227 |
| 3,327,320 | 6/1967 | Forsyth . | |
| 3,778,172 | 12/1973 | Myren | 401/7 |
| 3,883,897 | 5/1975 | Lefkowitz et al. . | |
| 4,523,348 | 6/1985 | Petrie . | |
| 4,620,528 | 11/1986 | Arraval | 15/227 |

OTHER PUBLICATIONS

Excerpt from The Merck Manual of Diagnosis and Therapy, 2030-1, Merck, Sharpe & Dohme Research Lab (1982).

Excerpt from Child's Body: A Parent's Manual, E26, Diagram Group (1977).

Excerpt from The Pediatric Nurse Practitioner, p. 101.

*Primary Examiner*—Steven A. Bratlie

*Attorney, Agent, or Firm*—Dann, Dorfman, Herrell and Skillman

[57] ABSTRACT

A mitten for therapeutically cleansing the scalp of an infant, particularly one disposed to a dermatological scalp condition, includes a plurality of soft bristles in a finger portion thereof for briskly but gently massaging the affected area. The mitten also includes a reservoir having an opening in a palmar portion thereof for collecting, holding and releasing water whereby the massaged area may be rinsed. The mitten is thus adapted for cleansing and rinsing with only one hand, the wearer's other hand being free to hold the infant.

13 Claims, 1 Drawing Sheet

FIG. 1
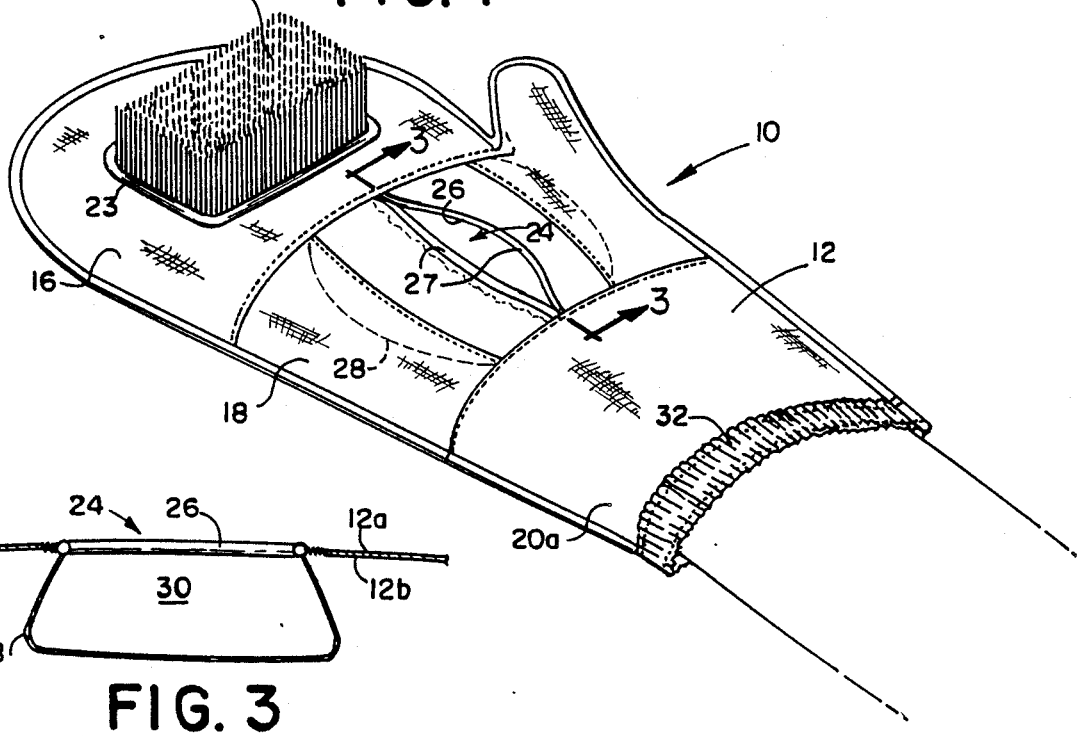
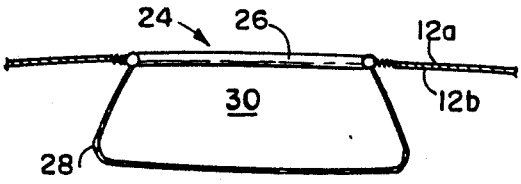
FIG. 3
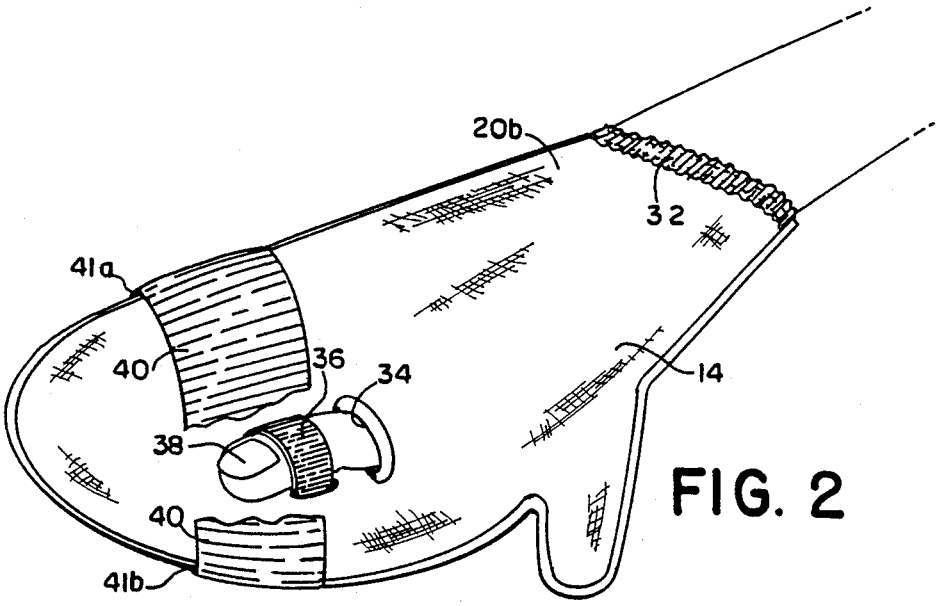
FIG. 2

THERAPEUTIC SCRUBBING MITTEN

FIELD OF THE INVENTION

This invention relates to devices for cleansing an infant and in particular to a novel scrub mitten particularly adapted for cleansing the infant's scalp.

BACKGROUND

Dermatological conditions such as sebhorreic dermatitis affect many newborn infants. Although medical treatments are available for these conditions, a frequently prescribed therapy is the regular cleansing of the infant in the affected area. In the case of the scalp conditions such as cradle cap, regular shampooing and massaging of the scalp is often prescribed. In order to remove the scales and oily matter associated with this condition vigorous scrubbing or massaging of the affected area is often recommended.

Given the prescribed treatment parents are often concerned that they will injure the infant's skin or the soft spots at the anterior and posterior aspects of its head. Moreover, a small infant must be supported while it is bathed and shampooed. This usually means that at least one of the parent's arms and hands must be used to support the baby leaving only one hand to do the bathing and shampooing.

It is now known that human immunodeficiency virus (HIV), the virus that causes acquired immunodeficiency syndrome (AIDS) is transmitted through exposure to infected blood and vaginal secretions associated with the delivery of a baby. Therefore, it is imperative that health care workers who handle newly born infants, especially those who cleanse the blood and bodily secretions from the newly born infant's head, wear protective hand coverings.

Accordingly, it would be highly desirable to have a hand covering which facilitates cleansing and shampooing of new infants, which provides means for gently but effectively massaging or scrubbing the scalp of an infant, particularly one affected with a dermatological condition, and which requires the use of only one hand by the person bathing the child.

SUMMARY OF THE INVENTION

The desired features described above are provided by the present invention which is embodied in a mitten for therapeutic cleansing of the scalp of an infant. The mitten has a flexible body formed to fit over the user's hand. The body of the mitten has a front panel and a back panel. The front panel includes a finger portion and a palmar portion. A plurality of soft bristles are secured to the finger portion of the mitten and may be used to provide a brisk but gentle massage to the infant's scalp. A reservoir for holding a quantity of water or other cleansing fluid is formed in the palmar portion. The reservoir has an opening, preferably in the palmar portion, for collecting and releasing water in order to rinse the area being cleansed. Thus only one hand is needed to cleanse and rinse the infant.

In other embodiments of the present invention, as described more fully hereinbelow, additional features such as means for sensing the temperature of the water while the mitten is being worn and means for assisting in removal of the mitten are provided.

A better understanding of these and other aspects of the invention may be had by referring to the following detailed description in conjunction with the drawings, wherein:

BRIEF DESCRIPTION OF THE DRAWINGS

FIG. 1 is a perspective view of the front panel of the scrub mitten according to the present invention;

FIG. 2 is a perspective view of the back panel of the scrub mitten of FIG. 1; and FIG. 3 is a sectional view as viewed along line 3—3 illustrating the reservoir in the mitten of FIG. 1.

DETAILED DESCRIPTION OF THE INVENTION

Referring now to the drawings, wherein like reference numerals refer to the same or corresponding elements among the several views, there is shown a scrub mitten 10 for therapeutically cleansing the scalp of an infant, particularly one having a dermatological condition. The mitten 10 has a front panel 12 and a rear panel 14. Front panel 12 has an outer surface **12*a* and an inner surface 12*b*. Both panels 12 and 14 are formed from a soft flexible sheet material which is preferably a water-resistant or non-absorbent fabric, e.g., nylon, Dacron®, etc. The sheet material can be of a highly durable quality for repeated use or can be a relatively inexpensive material such as latex, synthetic rubber, plastic, non-woven fabric or paper, or the like, to make the mitten 10 disposable. Panels 12 and 14 are fastened together along their respective edges to form the body of the mitten 10**.

The front panel 12 includes a finger portion 16 and a palmar portion 18. Front panel 12 also has a wrist portion **20*a* located near the open end of mitten 10. Back panel 14 has a corresponding wrist portion 20*b***.

A plurality of soft bristles 22 extend from a common base 23 which is secured to finger portion 16 in any suitable manner, e.g., stitching, adhesive, etc. The soft bristles 22 and the base 23 are positioned on finger portion 16 such that when mitten 10 is in use, the pressure needed to produce a massage effect can be exerted and controlled through the user's fingers against the base 23 which is preferably relatively stiff or rigid. Also the bristles 22 are preferably formed of a resilient, flexible water resistant material, for example material such as nylon. The individual bristles are stiff enough to stand alone, but flexible enough not to cause abrasion of the scalp tissue. In a further embodiment the bristles 22 terminate at their free end in rounded or beaded tips for reducing any abrasive effect of the bristles 22 on the soft scalp tissue. It is contemplated still further that the plurality of bristles 22 may be impregnated interstitially with a medicated substance which is water insoluble and capable of being released when the mitten 10 is used in bathing or shampooing an infant.

The density of the soft bristles 22 is chosen to provide both effective cleansing action and infant comfort. Thus, for an infant with little or no hair a high density of soft bristles 22 is preferred, whereas, for an infant with thick hair a lower density of bristles 22 of greater stiffness may be preferred.

A reservoir 24 is formed in the palmar portion 18. The reservoir includes an opening 26 in the front panel as shown in FIG. 1. A liner 28 as shown in FIG. 3 is secured to the inner surface **12*b* of front panel 12 to form a pocket or well 30 communicating with the opening 26. The liner 28 is formed of a water impervious material such as rubber, vinyl or other plastic and is secured to the inner surface 12*b* by any suitable method, e.g., stitching, adhesive, thermal bonding, etc. The pocket 30 is dimensioned to hold a preselected quantity of water or other cleansing liquid. Opening 26 is formed in the palmar portion 18 in such a manner that when the mitten 10 is fully extended, the opening 26 is closed and as the wearer's hand flexes by curving the fingers toward the palm the opening 26 becomes more circular. Such action creates a cup-like opening in the reservoir 24 whereby water or other cleansing liquid can be collected in the pocket 30** and released over the infant for rinsing. In this manner, both scrubbing and rinsing can be performed with only one hand.

In the embodiment shown in FIG. 1 such shaping of the opening 26 is accomplished by providing fabric piping 27 continuously attached along the edges of opening 26. The fabric piping 27 is stiffer than the adjacent fabric of palmar portion 18 such that when the wearer's hand is flexed in the aforesaid manner the fabric piping 27 bends to form the desired opening shape. An elastic member 29 is attached along one or both edges of opening 26 to facilitate opening and closing functions.

It is important to monitor the temperature of the bath water for the comfort and safety of the infant. Means are provided in the mitten 10 for determining the temperature of the water used to cleanse the infant. In the preferred embodiment, as shown in FIG. 2, an opening 34 is provided in back panel 14. Opening 34 is dimensioned and positioned to permit the wearer to extend his or her index finger 38 out from inside of the mitten. This facilitates determining the temperature of the water or other cleansing fluid being used to bath or shampoo the baby while the mitten 10 is being worn. A retention loop 36 is secured to the back panel 14 adjacent opening 34 in order to retain the index finger 38 such that the mitten may be manipulated with the index finger in this position.

Where it is not desirable to have the user's finger extend outside the mitten 10 a thermometer or other temperature indicating means is embodied in or affixed to back panel 14 by any suitable method so that the temperature of the water can be sensed and/or indicated directly.

A strap 40 is disposed across the width of back panel 14. Strap 40 is secured at each of its ends 41*a*, 41*b* to the mitten 10 by stitching or other suitable means. Strap 40 is provided to assist in removal of the mitten 10 from the wearer's hand and serves as a convenient means for hanging the mitten 10 up to dry after use. The strap 40 forms a loop which may be slid over a nearby hook or water faucet neck. By hooking the strap over the hook or faucet the mitten 10 may be oriented in a direction so that the wearer's hand can be withdrawn while the mitten 10 remains hooked. It is a feature and distinct advantage of this invention that it does not require the use of the wearer's opposite hand to remove the mitten.

Mitten 10 is retained on the wearer's hand by any suitable means. In the preferred embodiment shown in FIGS. 1 and 2, elastic band means 32 is provided about the wrist portions 20*a* and 20*b* adjacent the open end.

Some of the many novel features and advantages of the present invention are now apparent in view of the foregoing description. For example, a mitten for therapeutically cleansing the scalp of an infant has been described which includes a plurality of soft bristles in the finger area and a reservoir having an opening in the palmar area. The soft bristles are formed and positioned to permit brisk but gentle massage of the infant's scalp tissue. The reservoir is formed for collecting and releasing water and the like for rinsing. Thus, the cleansing and rinsing functions can be performed with only one hand, thereby freeing the other hand for holding the infant.

Additional features include a strap on the back panel of the mitten to assist in removing the mitten without the need for another hand. Also, means are provided for determining the bath water temperature while the mitten is being worn.

It will be recognized by those skilled in the art that changes or modifications may be made to the above-described embodiment without departing from the broad inventive concepts of the invention. It is understood, therefore, that the invention is not limited to the particular embodiment which is described, but is intended to cover all modifications and changes within the scope and spirit of the invention as defined in the appended claims.

What is claimed is:

1. A mitten for therapeutic cleansing of the scalp comprising:

a body of flexible sheet material formed to fit over a hand, said body having a front panel and a back panel, said front panel having a finger portion, a palmar portion and a panel opening formed in the palmar portion, said panel opening having a major dimension coextensive with the palmar portion of said front panel;

a plurality of soft bristles secured to the finger portion of said front panel;

reservoir means underlying said palmar portion for holding a quantity of liquid, said reservoir means communicating with the panel opening; and means for retaining said body on the hand.

2. A mitten as recited in claim 1 further comprising piping means disposed along an edge of the panel opening for facilitating the opening and closing of said panel opening such that when the finger portion of the front panel is displaced toward the palmar portion, said piping means bends so as to open the panel opening such that a rinsing liquid can be collected into or released from the reservoir means.

3. A mitten as recited in claim 2 wherein said front panel has inner and outer surfaces, and said reservoir means comprises:

liner means secured to the inner surface of said front panel so as to form a pocket communicating with said panel opening.

4. A mitten as recited in claim 3 wherein said liner means is formed of water impervious material.

5. A mitten as recited in claim 1 wherein said plurality of soft bristles are formed of a resilient flexible material projecting from a common base which is secured to said finger portion.

6. A mitten as recited in claim 1 further comprising means for determining the temperature of the rinsing liquid while said mitten is being worn.

7. A mitten as recited in claim 1 wherein the back panel has an opening dimensioned and positioned for allowing a finger of the hand to extend outside the body of the mitten whereby the wearer can sense the temperature of the rinsing liquid while the mitten is being worn.

8. A mitten as recited in claim 7 further comprising strap means extending across the width of the back panel and secured at its ends to the mitten such that a loop is formed for assisting in removal of the mitten from the wearer's hand.

9. A mitten as recited in claim 1 wherein said front panel and said back panel have wrist portions and said means for retaining said fabric body on the hand comprises elastic means disposed about said wrist portions.

10. Apparatus for therapeutic cleansing of the scalp comprising:

a plurality of soft bristles;

means for retaining said plurality of soft bristles on the fingers of a hand;

reservoir means formed for holding a quantity of rinsing liquid, said reservoir means having an opening operable to be opened, closed and opened respectively to collect, retain and release the rinsing liquid;

piping means disposed along an edge of the reservoir opening for facilitating the closing and opening of said reservoir means such that when the fingers of the hand are displaced toward the palm of the hand said piping means bends so as to open the reservoir means whereby the rinsing liquid can be collected or released; and means for retaining said reservoir means on the palm of the hand.

11. A therapeutic scrubbing apparatus as recited in claim 10 wherein said plurality of soft bristles are formed of a resilient flexible material projecting from a common base which is secured to said bristle retaining means.

12. A mitten as recited in claim 3 wherein said piping means comprises elastic means for facilitating bending of said piping means when the finger portion is displaced toward the palmar portion.

13. A mitten as recited in claim 6 wherein said temperature determining means comprises a thermometer disposed on said back panel.

* * * * *